United States Patent [19]

Neubauer

[11] Patent Number: 4,729,506

[45] Date of Patent: Mar. 8, 1988

[54] MAILER WITH TRANSPARENT PATCH

[75] Inventor: Frank Neubauer, Brewster, N.Y.

[73] Assignee: Transkrit Corporation, Brewster, N.Y.

[21] Appl. No.: 11,210

[22] Filed: Feb. 4, 1987

[51] Int. Cl.[4] ..... B65D 27/04; B65D 27/10

[52] U.S. Cl. ..... 229/69; 229/71

[58] Field of Search ..... 229/69, 71

[56] References Cited

U.S. PATENT DOCUMENTS

| | | | |
|---|---|---|---|
| 3,104,799 | 9/1963 | Steidinger | 229/69 |
| 3,408,908 | 11/1968 | Berkowitz | 229/71 |
| 3,952,942 | 4/1976 | O'Leary et al. | 229/69 |
| 4,172,605 | 10/1979 | Welsch et al. | 229/69 |

FOREIGN PATENT DOCUMENTS

| | | | |
|---|---|---|---|
| 102792 | 3/1984 | European Pat. Off. | 229/71 |
| 161871 | 11/1985 | European Pat. Off. | 229/69 |

*Primary Examiner*—Stephen P. Garbe

*Attorney, Agent, or Firm*—Kenyon & Kenyon

[57] ABSTRACT

The front ply of the mailer is provided with a cutout window and a transparent patch over the window. The patch is provided with a CB coating while the underlying area of the insert ply is provided with a CF coating for chemically reacting with the first coating in response to an impact force from a stylus on the patch. Imaged information on the insert ply can be viewed through the transparent patch while being protected by the patch.

12 Claims, 6 Drawing Figures

MAILER WITH TRANSPARENT PATCH

This invention relates to a mailer having a transparent patch. More particularly, this invention relates to a continuous mailer assembly having mailers with windows.

As is known, various types of multi-ply envelope assemblies have been made so that information can be generated on the outside and inside plies, for example, by various types of automated printers such as computer printers. For example, U.S. Pat. No. 4,425,386 describes a multi-ply business form wherein coatings are provided on the top surfaces of a top ply and a underlying ply so that when a printing stylus, such as that in a typewriter, impacts against the plies, an image is produced on the top surfaces of each ply. In such cases, there is no need to use a ribbon.

Other types of envelopes have also been known, for example as described in U.S. Pat. No. 3,104,799 wherein use is made of a spot of carbon on a rear face of a front ply to provide for selective imprinting on an underlying ply in response to the impact of a stylus on the front ply. Similar structures are also described in U.S. Pat. Nos. 3,350,988; 3,791,572; 3,941,308 and 4,172,605.

Further, in some cases, mailers have been provided with windows in the front ply for visualization of the information imaged on an underlying insert ply. In such cases, the information can be imaged by typing the information directly onto the insert ply through the window, for example, through use of a ribbon or the like, or the information can be imaged via a surface coating which permits an image to be formed upon impact by a stylus. However, mailers which have been provided with information in this manner expose the insert ply. Hence, the image which has been placed on the insert ply may become blurred or damaged during a mailing/delivery process, for example due to inclement weather. Further, the windows of such mailers permit entry into the interior of the mailer so that the security of the information within the remainder of the mailer is impaired.

Accordingly, it is an object of the invention to provide a mailer with a transparent area through which information can be viewed while maintaining the sealed integrity of the mailer.

It is another object of the invention to be able to apply visual images to a mailer while protecting the image against damage.

It is another object of the invention to provide a visual image on an insert ply of a mailer in a protected manner.

Briefly, the invention provides a mailer which is comprised of a front ply having a transparent section, a back ply secured to the front ply to define an enclosed pocket and at least one insert ply between the front and back plies. In accordance with the invention, a coating containing a colorless dye is provided on the backside surface of the transparent section while a coating containing a color developing material for reacting with the first coating is applied on the insert ply in order to produce an image on the insert ply in response to an impact force being applied on the transparent section for visualization through the transparent section.

In one embodiment, the first ply is in the form of a paper ply with a cut-out window while the transparent section is formed by a transparent patch which is secured over the window. In addition, at least one spot carbon patch is provided on the backside of the front ply in facing relation to the insert for transferring of an image onto the insert.

In another embodiment, the front ply is provided with a CB coating on a backside facing the insert while the insert is provided with a CF coating facing the front ply. In this respect, the CB (coated back) coating may be made of any suitable material, for example a suspension of microcapsules containing a colorless dye. The CF (coated front) coating may also be of any suitable material, for example a material containing a color developing material. When pressure is applied to the CB coating, the microcapsules are ruptured allowing the colorless dye to react chemically with the color developing material of the CF coating, thus resulting in visualization or imaging of the dye.

The transparent patch may be made of any suitable material, for example being made of a material selected from the group consisting of glassine, cellophane, polyethylene and polyvinylchloride.

For business purposes, a continuous mailer assembly may also be provided which is made up of a plurality of interconnected mailers of the above type. In this case, where such a mailer assembly is provided with suitable pin hole strips, the assembly can be passed through automatic equipment, such as a computer printer, with information then being imprinted not only on the front side of the top ply of each mailer but also on the front side of each insert ply via the spot carbon or CB coatings. In particular, information can be imprinted on the insert ply through the transparent section of the front ply for viewing purposes.

The information which is located directly underneath the transparent section of the front ply is protected by the transparent section from the exterior environment and particularly from inclement weather after the mailer has been posted. Further, the transparent section maintains the integrity of the sealed mailer so that exposure of the contents of the mailer can be inhibited.

These and other objects and advantages of the invention will become more apparent from the following detailed description taken in conjunction with the accompanying drawings wherein.

Figure 1:
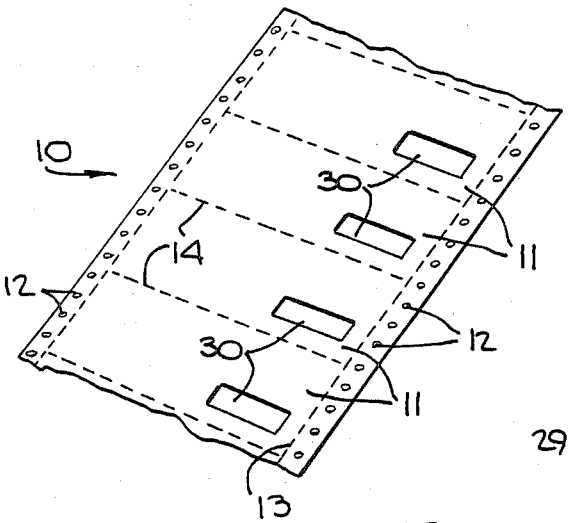
FIG. 1 illustrates a part perspective view of a continuous mailer assembly constructed in accordance with the invention.

Referring to FIG. 1, the continuous mailer assembly 10 is of generally conventional structure having a plurality of interconnected mailers 11 with a longitudinal row of pin holes 12 at each side of the assembly 10. As indicated, longitudinal lines of weakening or perforations 13 are provided along the row of holes 12 in order to permit removal of the strips containing the holes 12. Likewise, suitable transfer lines of weakening or perforations 14 are provided to separate the mailers 11 from each other.

Figure 2:
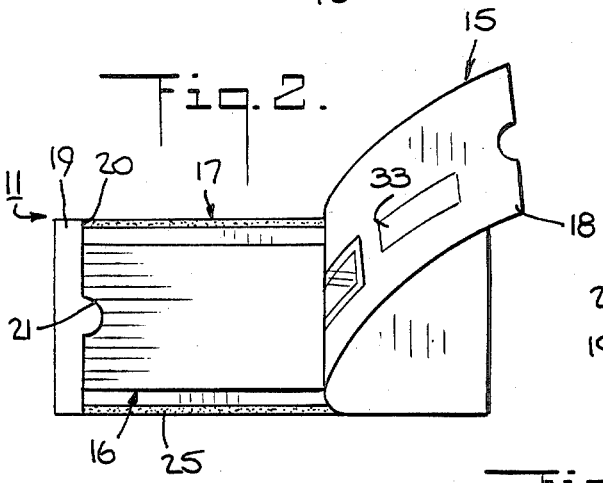
FIG. 2 illustrates a partially opened mailer constructed in accordance with the invention.

Referring to FIGS. 1 and 2, each mailer 11 is formed of three plies 15, 16, 17. The top or front ply 15 has a main portion 18 and a tab portion 19 which are separated from each other by a line of weakening or perforations 20. In addition, the line of weakening 20 is shaped to form a thumb notch 21 at a mid-point as is known.

The back ply 17 is of the same size as the front ply 15 and also includes a similar main portion 22 and a tab portion 23 (see FIG. 5) which are separated by a line of weakening or perforations 24. As above, the line of weakening 24 forms a thumb notch at the mid-point. In addtion, suitable lines of glue 25 are provided to secure the front ply 15 and back ply 17 together about the rectangular periphery.

The insert ply 16 is of smaller dimensions than the front and back plies 15, 17 and is sized to fit within the rectangular frame defined by the lines of adhesive 25. In addition, the insert ply 16 has a main portion 26 and a tab portion 27 (see FIG. 5) which are separated by a line of weakening or perforations 28. However, this line of weakening is not shaped to provide a thumb notch.

Figure 3:
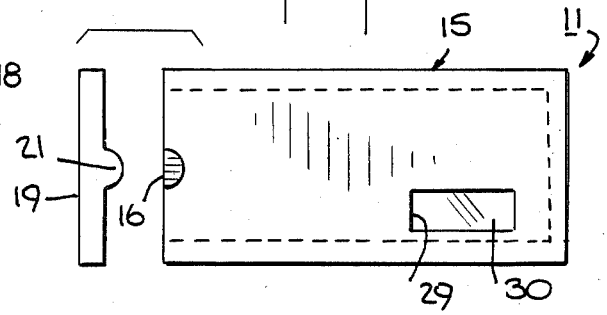
FIG. 3 illustrates a view of a mailer during opening of the mailer by a recipient.

The tab portions 19, 23, 27 are disposed in overlying relation and are adhesively secured to each other so as to be removed simultaneously from the mailer as indicated in FIG. 3. In addition, the thumb notch sections of the tab portions 19, 23 are shaped such as to provide for gripping of the insert ply 16 for removal from the remainder of the mailer as also indicated in FIG. 3.

The above construction of the mailer is generally known and need not be further described.

Figure 4:
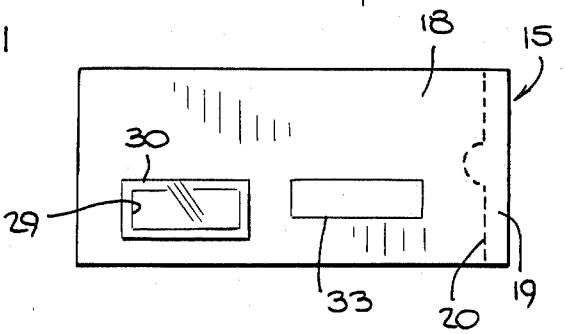
FIG. 4 illustrates a view of the backside of the front ply of the mailer of FIG. 2.

Referring to FIGS. 2 and 4, the front ply 15 is also provided with a cut-out window 29 over which a transparent patch 30 is secured by a suitable adhesive so that the ply 15 is provided with a transparent section. As indicated in FIG. 4, the patch 30 is secured to the back side of the front ply 15. The patch 30 is made of any suitable transparent material, for example being made of a material selected from the group consisting of glassine, cellophane, polyethylene and polyvinylchloride. Of course, any other suitable transparent material may also be used.

Figure 5:
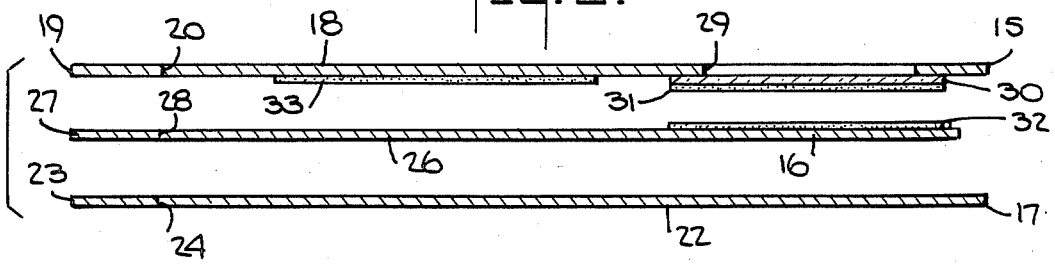
FIG. 5 illustrates an exploded cross-sectional view of the mailer of FIG. 2.

Referring to FIG. 5, the patch 30 is also provided with a CB (coated back) coating while the opposed surface of the insert ply 16 is provided with a CF (coated front) coating. For example, the coatings are such so that one reacts with the other to produce an image on the insert ply 16 in response to an impact force being applied on the patch 30 for visualization through the patch 30. By way of example, the CB coating 31 may be a suspension of microcapsules containing a colorless dye while the CF coating 32 contains a color developing material for reacting chemically with the colorless dye when the microcapsules are ruptured.

Referring to FIGS. 4 and 5, the back side of the front ply 15 may also be provided with one or more spot carbon patches 33 in a conventional manner to provide for further imaging of the insert ply 16.

Figure 6:
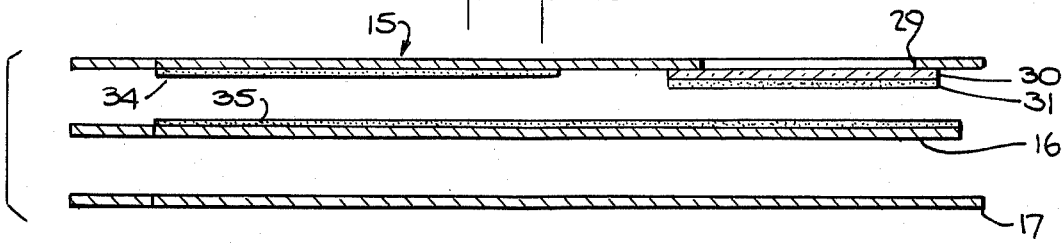
FIG. 6 illustrates an exploded cross-sectional view of a modified mailer in accordance with the invention.

Referring to FIG. 6, wherein like reference characters indicate like parts as above, the back side of the front ply 15 may also be provided with a CB coating 34 in one or more areas outside of the window 29 while the insert ply 16 is provided with a suitable CF coating 35 in opposed areas.

During processing of the mailer assembly 10, for example, in a computer printer, information can be imaged directly on the exposed surface of the front ply 15 as well as on the top side surface of the insert ply 16 using conventional techniques. In addition, the insert ply 16 may be imaged through the transparent patch 30 so that the imaged information can be readily viewed. In this regard, the imprinting device would be a blind or ribbonless type. As a result, there is no need to maintain an inventory of different types of ribbons for imaging information onto the mailers of the assembly.

The invention thus provides a mailer in which printing can be performed on the front ply by machines without ribbons or with colorless ribbons so that only information showing through the transparent patch 30 would be readable.

The invention further provides a mailer wherein a stylus is able to "type through" the transparent patch so that an image is printed on an underlying insert ply, for example, the address of an addressee. When a web of such mailers is fed through automatic equipment, each mailer can be "typed" with the address of a different addressee. After processing through the equipment, the mailer assembly can be burst apart with the individual mailers then being mailed to the various addressees.

The invention further provides a mailer which maintains the integrity of the information contained within the mailer while protecting against damage to the address information due to inclement weather conditions.

What is claimed is:

1. A mailer comprising a front ply having a transparent section;

a first coating on a backside surface of said transparent section containing a colorless dye;

a back ply secured to said front ply to define an enclosed pocket;

at least one insert ply between said front ply and said back ply; and a second coating on said insert ply in facing relation to said first coating, said second coating having a color developing material for reacting with said first coating to produce an image on said insert ply in response to an impact force being applied on said transparent section for visualization through said transparent section.

2. A mailer as set forth in claim 1 wherein said first ply includes a paper ply with a cut-out window and a transparent patch secured over said window to define said transparent section.

3. A mailer as set forth in claim 2 wherein said first coating includes a suspension of microcapsules containing said colorless dye.

4. A mailer as set forth in claim 2 wherein said front ply is a carbonless transfer paper.

5. A mailer as set forth in claim 2 wherein said front ply has at least one spot carbon patch on a backside facing said insert for transferring of an image onto said insert.

6. A mailer as set forth in claim 2 wherein said front ply is provided with a CB coating on a backside facing said insert and said insert is provided with a CF coating facing said front ply.

7. A mailer comprising a front ply having a cut-out window;

a transparent patch secured over said window;

a back ply secured to said front ply to define an enclosed pocket;

at least one insert ply between said front ply and said back ply;

a first coating on said patch in facing relation to said insert; and a second coating on said insert in facing relation to said first coating to react with said first coating to produce a visual image on said insert in response to an impact force being applied on said patch.

8. A mailer as set forth in claim 7 wherein said first coating is a CB coating and said second coating is a CF coating.

9. A mailer as set forth in claim 8 wherein said patch is made of a material selected from the group consisting of glassine, cellophane, polyethylene and polyvinylchloride.

10. A mailer as set forth in claim 7 wherein said CB coating is a suspension of microcapsules containing a colorless dye and said CF coating includes a color developing material for reacting chemically with the dye in response to rupturing of said microcapsules.

11. A mailer as set forth in claim 10 wherein said patch is made of a material selected from the group consisting of glassine, cellophane, polyethylene and polyvinychloride.

12. A continuous mailer assembly comprising a plurality of interconnected mailers, each said mailer comprising a front ply having a cut-out window, a transparent patch secured over said window, a back ply secured to said first ply to define an enclosed pocket, at least one insert ply between said front ply and said back ply, a first coating on said patch in facing relation to said insert, and a second coating on said insert in facing relation to said first coating to react with said first coating to produce an image on said insert in response to an impact force being applied on said patch for visualization through said patch.

* * * * *